US009289660B1

(12) United States Patent
Myers

(10) Patent No.: US 9,289,660 B1
(45) Date of Patent: Mar. 22, 2016

(54) GOLF CLUB HEAD WITH ADJUSTABLE CENTER OF GRAVITY

(71) Applicant: CALLAWAY GOLF COMPANY, Carlsbad, CA (US)

(72) Inventor: Matthew Myers, Carlsbad, CA (US)

(73) Assignee: CALLAWAY GOLF COMPANY, Carlsbad, CA (US)

( * ) Notice: Subject to any disclaimer, the term of this patent is extended or adjusted under 35 U.S.C. 154(b) by 238 days.

(21) Appl. No.: 14/174,068

(22) Filed: Feb. 6, 2014

Related U.S. Application Data

(63) Continuation-in-part of application No. 14/163,946, filed on Jan. 24, 2014, which is a continuation-in-part of application No. 14/033,218, filed on Sep. 20, 2013, now Pat. No. 8,696,491, which is a continuation-in-part of application No. 13/923,571, filed on Jun. 21, 2013, now Pat. No. 9,084,921, which is a continuation-in-part of application No. 13/778,958, filed on Feb. 27, 2013, now Pat. No. 8,894,506, said application No. 14/163,946 is a continuation-in-part of application No. 13/766,658, filed on Feb. 13, 2013, now Pat. No. 8,790,195.

(60) Provisional application No. 61/902,036, filed on Nov. 8, 2013, provisional application No. 61/893,728, filed on Oct. 21, 2013, provisional application No. 61/727,608, filed on Nov. 16, 2012, provisional application No. 61/746,348, filed on Dec. 27, 2012.

(51) Int. Cl.
*A63B 53/04* (2015.01)
*A63B 53/06* (2015.01)
*A63B 59/00* (2015.01)

(52) U.S. Cl.
CPC ..... *A63B 53/06* (2013.01); *A63B 53/0466* (2013.01); *A63B 59/0074* (2013.01)

(58) Field of Classification Search
USPC ..... 473/324–350
See application file for complete search history.

(56) References Cited

U.S. PATENT DOCUMENTS 5,688,189 A * 11/1997 Bland ..... A63B 53/065 473/314
6,015,354 A * 1/2000 Ahn ..... A63B 53/04 473/256
6,277,032 B1 * 8/2001 Smith ..... A63B 53/04 473/336
7,452,286 B2 * 11/2008 Lin ..... A63B 53/0466 473/334
7,611,424 B2 * 11/2009 Nagai ..... A63B 53/0466 473/334
7,775,905 B2 * 8/2010 Beach ..... A63B 53/0466 473/256

(Continued)

FOREIGN PATENT DOCUMENTS

JP 06238022 A * 8/1994
JP 2005323978 A * 11/2005

(Continued)

*Primary Examiner* — Alvin Hunter
(74) *Attorney, Agent, or Firm* — Rebecca Hanovice; Michael Catania; Sonia Lari

(57) ABSTRACT

A golf club head comprising a means for adjusting the location of the center of gravity, and the bias of the golf club head, is disclosed herein. In particular, the golf dub head of the present invention comprises a channel that includes a track. A slidable weight is movable along the track and is reversibly affixed to various locations along the track with a mechanical fastener. The track has a narrow end by which the slidable weight is threaded onto the track, and the narrow end is covered with a stopper to prevent the weight from disengaging from the track, and thus the channel.

19 Claims, 4 Drawing Sheets

(56) References Cited

U.S. PATENT DOCUMENTS

| | | | | |
|---|---|---|---|---|
| 8,016,694 | B2 * | 9/2011 | Llewellyn | A63B 53/0466 473/334 |
| 8,202,175 | B2 * | 6/2012 | Ban | A63B 53/0466 473/334 |
| 8,696,491 | B1 * | 4/2014 | Myers | A63B 53/0466 473/334 |
| 8,894,506 | B1 * | 11/2014 | Myers | A63B 56/0466 473/334 |
| 9,084,921 | B1 * | 7/2015 | Liang | A63B 53/06 |
| 9,174,096 | B2 * | 11/2015 | Sargent | A63B 53/0466 |
| 2005/0137024 | A1 * | 6/2005 | Stites | A63B 53/047 473/291 |
| 2006/0122004 | A1 * | 6/2006 | Chen | A63B 53/0466 473/335 |
| 2006/0172821 | A1 * | 8/2006 | Evans | A63B 53/0466 473/349 |
| 2006/0178228 | A1 * | 8/2006 | DiMarco | A63B 53/0466 473/334 |
| 2006/0240908 | A1 * | 10/2006 | Adams | A63B 53/0466 473/334 |
| 2008/0261715 | A1 * | 10/2008 | Carter | A63B 53/0466 473/291 |

FOREIGN PATENT DOCUMENTS

| | | | |
|---|---|---|---|
| JP | 2006320493 | A * | 11/2006 |
| JP | 2008194454 | A * | 8/2008 |
| JP | 2010069106 | A * | 4/2010 |
| JP | 2010136772 | A * | 6/2010 |
| JP | 2010148702 | A * | 7/2010 |
| JP | 2010252964 | A * | 11/2010 |
| JP | 2011010722 | A * | 1/2011 |

* cited by examiner

GOLF CLUB HEAD WITH ADJUSTABLE CENTER OF GRAVITY

CROSS REFERENCES TO RELATED APPLICATIONS

The present application claims priority to U.S. Provisional Patent Application No. 61/902,036, filed on Nov. 8, 2013, and is a continuation in part of U.S. patent application Ser. No. 14/163,946, filed on Jan. 24, 2014, which claims priority to U.S. Provisional Patent Application No. 61/893,728, filed on Oct. 21, 2013, and which is a continuation-in-part of U.S. patent application Ser. No. 14/033,218, filed on Sep. 20, 2013, which is a continuation-in-part of U.S. patent application Ser. No. 13/923,571, filed on Jun. 21, 2013, which is a continuation-in-part of U.S. patent application Ser. No. 13/778,958, filed on Feb. 27, 2013, which claims priority to U.S. Provisional Patent Application No. 61/727,608, filed on Nov. 16, 2012, and U.S. patent application Ser. No. 14/163,946 is also a continuation-in-part of U.S. patent application Ser. No. 13/766,658, filed on Feb. 13, 2013, which claims priority to U.S. Provisional Patent Application No. 61/746,348, filed on Dec. 27, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a weight for a golf club head that can be adjusted along one or more channels.

2. Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention is a novel way of working with adjustable products. The present invention allows consumers to easily move and fix a weight at any location within one or more channels disposed in the golf club head in such a way to maximize aesthetic appearances while preserving the function of the movable weight. The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

One aspect of the present invention is a golf club head comprising a body comprising a face and a sole, a crown, a track, a mechanical fastener, and a first weight comprising a lower recess, wherein the sole comprises a channel having at least two walls and a floor, wherein the track is at least partially disposed within the channel, wherein the weight receives an upper portion of the track within the lower recess, and wherein the weight is reversibly affixed to the track with the mechanical fastener. The channel may comprise a floor and a track opening, the track may comprise a lower edge sized to fit within the track opening, and the track may be permanently affixed to the body within the channel. In some embodiments, the body may be integrally cast from a metal material, the track may be composed of a metal material, and the crown may be composed of a composite material.

In one embodiment, the weight may comprise an upper recess, a threaded bore that connects the upper recess with the lower recess, and two hooked lower edges, the mechanical fastener may comprise a threaded extension sized to fit within the threaded bore, and the track may comprise a I-shaped cross section. In some embodiments, the body may comprise a plurality of internal ribs, each of which may be affixed to the floor of the channel. In another embodiment, the golf club head may further comprise a stopper sized to it within the channel and over the track, which may prevent the weight from detaching from the track. In some embodiments, the stopper may be composed of a material selected from the group consisting of plastic, composite, and rubber, while in other embodiments the stopper may be composed of a material selected from the group consisting of stainless steel, titanium alloy, aluminum alloy, and tungsten alloy.

In one embodiment, the track may comprise a first end having a first width and a second end having a second width, and the first width may be smaller than the second width. In another embodiment, the golf club head may further comprise a second weight, which may comprise a lower recess sized to receive an upper portion of the track. In some embodiments, the track may be welded to the body. In yet another embodiment, the golf club head may comprise an adjustable hosel assembly, and may be selected from the group consisting of a driver-type head, a fairway wood-type head, an iron-type head, a hybrid-type head, and a putter-type head.

Another aspect of the present invention is a wood-type golf club head comprising a metal body comprising a face, a hosel, a heel side, a toe side, and a sole, a composite crown, a metal track comprising a lower edge, a first end having a first width, a second end having a second width, and an upper portion having an upper surface, a screw comprising a head and a threaded extension, a weight comprising an upper recess, a lower recess sized to receive the upper portion of the track, and a threaded bore connecting the upper recess with the lower recess, and a stopper, wherein the sole comprises a channel having at least two walls, a floor, and a track opening, wherein the channel extends from the heel side to the toe side, wherein the lower edge of the track fits within the track opening, wherein the weight is reversibly fixed to the track with the screw, and wherein the stopper prevents the weight from disengaging from the track. In some embodiments, the track may be welded to the body, or may comprise a protective cover. In other embodiments, the body may comprise a plurality of ribs, and each of the ribs may be affixed to an interior surface of the channel floor. In yet another embodiment, the track may be composed of anodized aluminum.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. The embodiments may also work in conjunction with at least one adjustable weight port on the sole, crown, and/or other part of the driver head. Shifting weight along the channel described herein gives a user control of the golf club head's center of gravity location.

Figure 5:
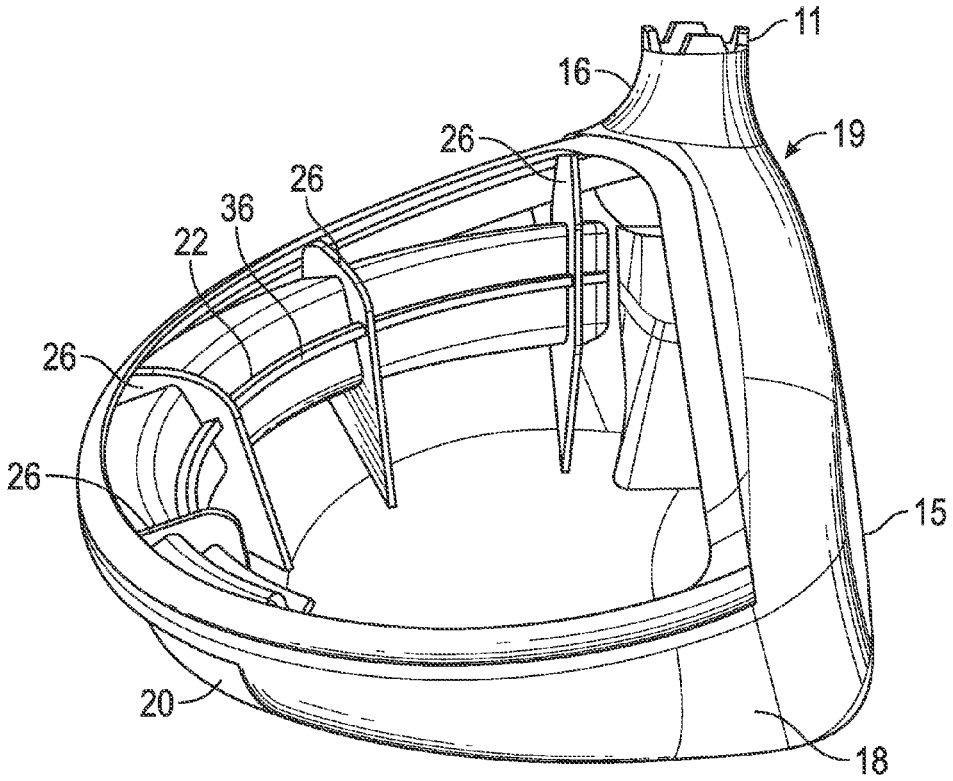
FIG. 5 is an assembled view of the embodiment shown in FIG. 3.
Figure 6:
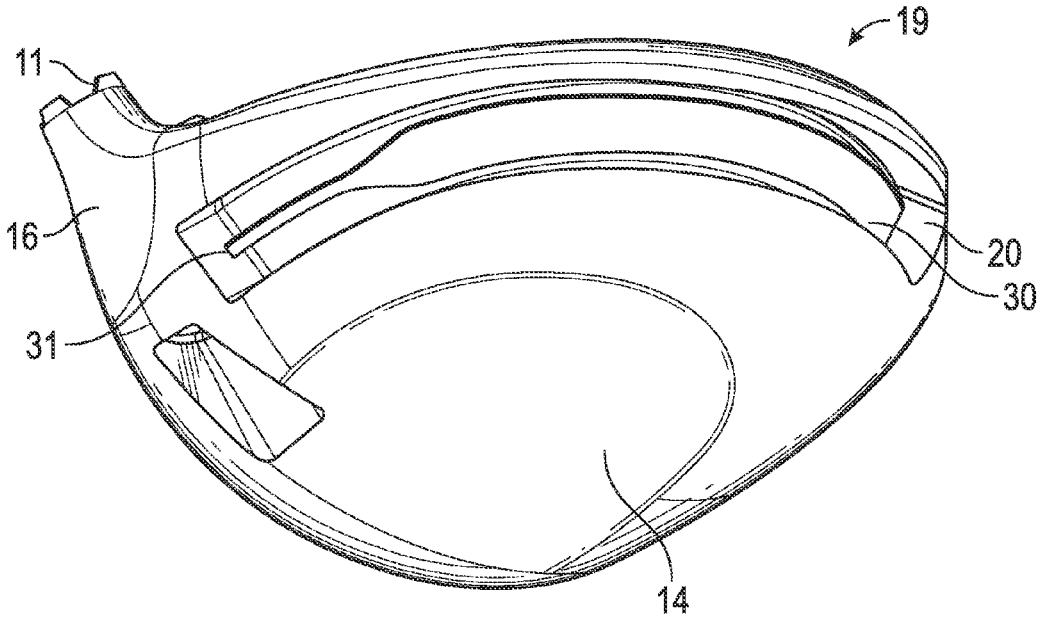
FIG. 6 is sole perspective view of the embodiment shown in FIG. 5.

A preferred embodiment of the present invention is shown in FIGS. 1-7. The golf club head 10 comprises a channel 20 disposed within the sole 14 of the golf club head 10, though in alternative embodiments the channel 20 may be disposed in a ribbon or skirt portion and/or in the crown 12 of the golf club head 10. The channel 20 preferably is integrally cast with the sole 14, hut in alternative embodiments may be separately formed and then permanently affixed the sole 14 or other portions of the golf club head 10. The channel 20 extends from a heel side 16 of the club head proximate a hosel 11, which preferably includes adjustability features, to a toe side 18 of the golf club head 10, and is supported within the head 10 with a series of ribs 26. The channel 20 includes a track 30, which protrudes from a floor 25 of the channel 20, has a T-shaped cross section, and has a narrow first end 31 and a wider second end 33. As shown in FIG. 6, the width of the track 30 abruptly tapers to the narrow first end 31 so that most of the length of the track 30 can be used as a guide for the weight 40, which can be removed from the track 30 by sliding the weight 40 off of the narrow first end 31.

Figure 1:
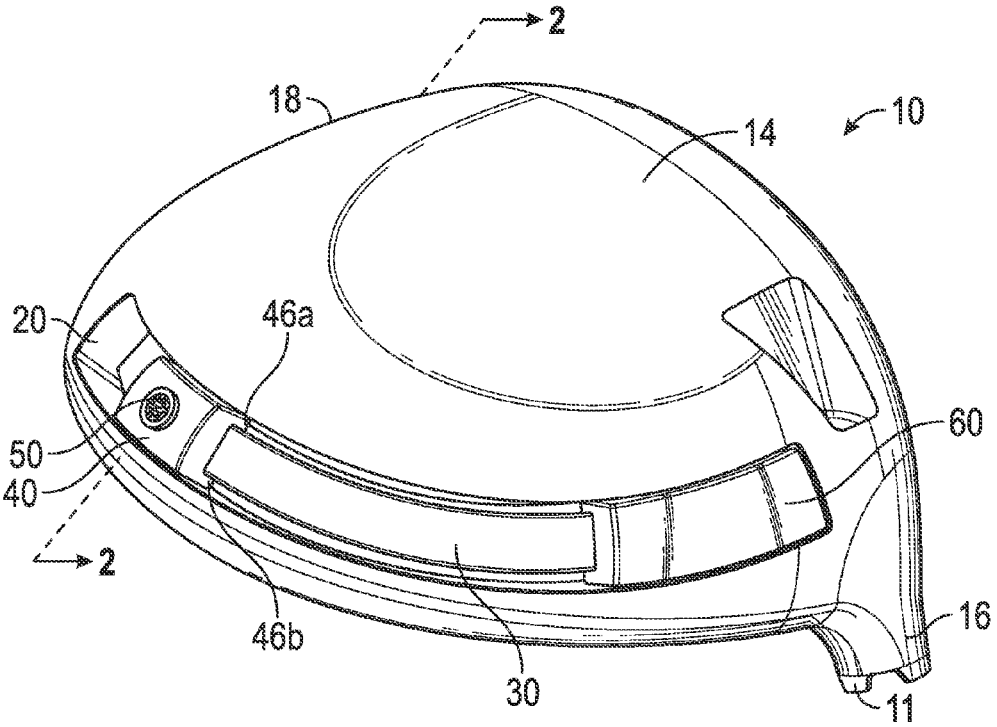
FIG. 1 is a sole perspective view of a preferred embodiment of the present invention.
Figure 2:
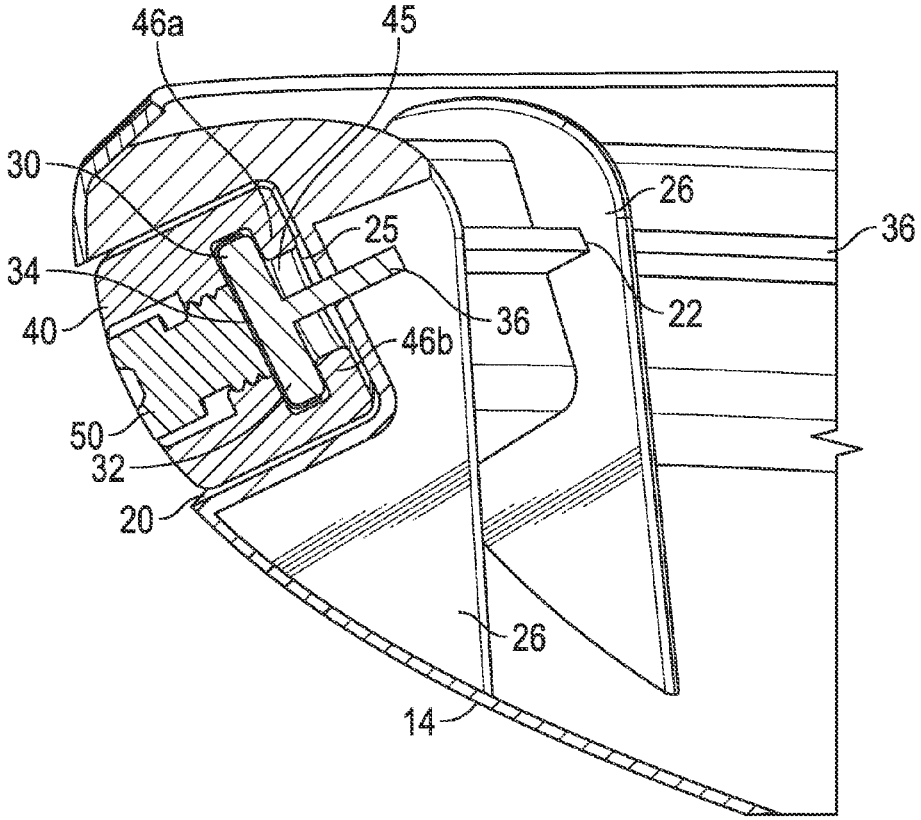
FIG. 2 is a cross-sectional view of the embodiment shown in FIG. 1 along lines 2-2.

A weight 40, which is significantly smaller in length than the channel 20 and slightly smaller in width than the channel 20, is sized to fit within the channel 20 and includes a T-shaped lower recess 45 sized to receive the upper, T-shaped part of the track 30. When the track 30 is engaged with the lower recess 45 of the weight 40 as shown in FIG. 2, the weight can slide to any point along the track 30. A stopper 60 is removably affixed over the narrow first end 31 of the track 30 within the channel 20 with semi-permanent adhesives, mechanical fasteners, or other means known to a person skilled in the art, to prevent the weight 40 from becoming disengaged from the track 30 at the narrow first end 31, and thus the channel 20, during use. In an alternative embodiment, the stopper 60 may be permanently affixed to the head 10 so that the weight 40 is permanently retained within the channel 20 on the track 30. The stopper 60 may be made of a light-weight material such as composite, rubber, or another polymer, but preferably functions as another weight and is composed of a denser material such as titanium, steel, or tungsten.

When a user has adjusted the weight's 40 location along the track to a desired point, he or she can removably fix the weight 40 to that location with a screw 50, which is received in an upper recess 42 of the weight 40. The threaded portion 55 of the screw 50 extends through a threaded bore 44 that connects the upper recess 42 to the lower recess 45 of the weight 40 and; when it is fully screwed into the weight 40, makes contact with an upper surface 32 of the track 30. When the threaded portion 55 of the screw 50 makes contact with the track 30, it pushes the weight 40 away from the track 30 such that the hooked, lower edges 46*a*, 46*b* of the weight 40 press against the underside of the track 30, thereby reversibly locking the weight 40 onto the track 30. The upper surface 32 of the track 30 preferably includes a protective cover 34, which may be made from a material including, but not limited to, a rubber, felt, or a co-molded polymer, so that neither the screw 50 nor the track 30 becomes damaged when they make contact with each other. In an alternative embodiment, the upper surface 32 of the track 30 is protected with u plate (not shown), which may be located within the lower recess 45 of the weight 40 and/or affixed to a lower surface of the threaded portion 55 of the screw 50 and be pressed towards the track 30 when the screw 50 is tightened by a user.

Figure 3:
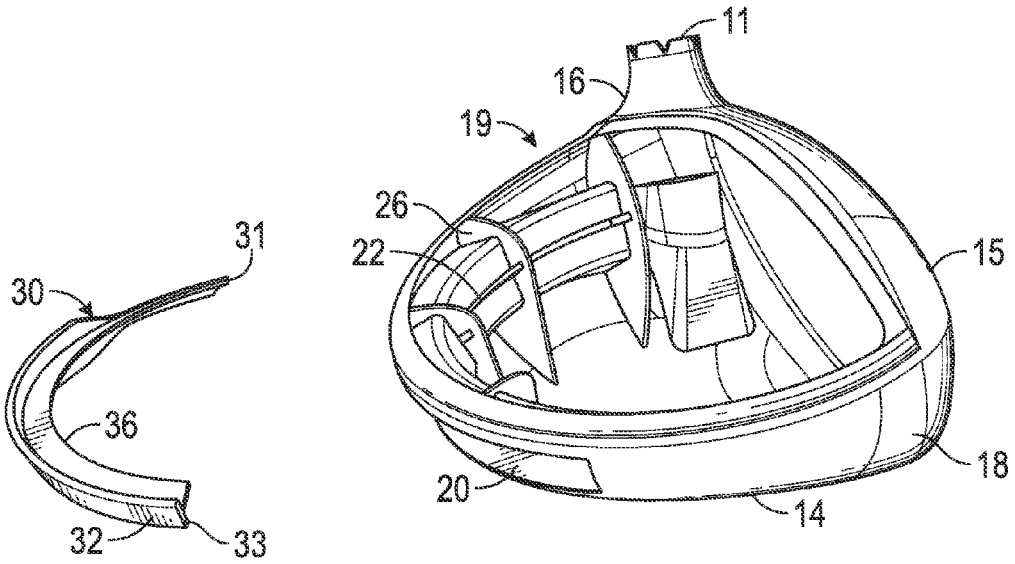
FIG. 3 is a first exploded view of the embodiment shown in FIG. 1.
Figure 4:
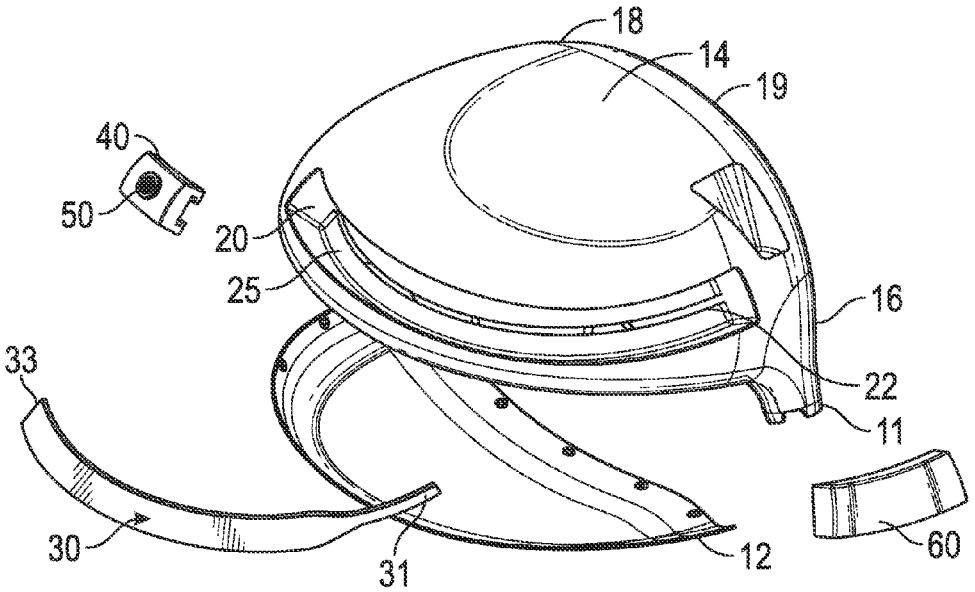
FIG. 4 is a second exploded view of the embodiment shown in FIG. 1.

The golf club head 10 of the present invention preferably is assembled as shown in FIGS. 3-7. First, a body 19 comprising the hosel 11, sole 14, and face 15 is cast from a metal material, which preferably is a titanium alloy, hut in other embodiments may be steel. The channel 20 is integrally cast with the body 19, and then aback opening 22 is cut into the floor 25 of the channel 20 using a laser, a cutter, or any other means known to a person skilled in the art. The track 30 is cast or otherwise formed from a metal material, preferably an anodized aluminum alloy, and the lower edge 36 of the track 30 is inserted into the track opening 22 and permanently affixed there via welding, soldering, brazing, or another means known to a person skilled in the art, as shown in FIGS. 5 and 6. The track opening 22 preferably extends into the ribs 26 as shown in FIG. 3 so that the lower edge 36 of the track 30 is supported by the ribs 26 when it is inserted into the track opening 22. In alternative embodiments, the track 30 may be affixed to the channel 20 with one or more mechanical fasteners, an adhesive, clip or snap mechanisms, or one or more of the mechanisms disclosed in U.S. Pat. No. 7,147,573 to DiMarco and U.S. Pat. No. 7,166,041 to Evans, the disclosure of each of which is hereby incorporated by reference in its entirety herein.

Figure 7:
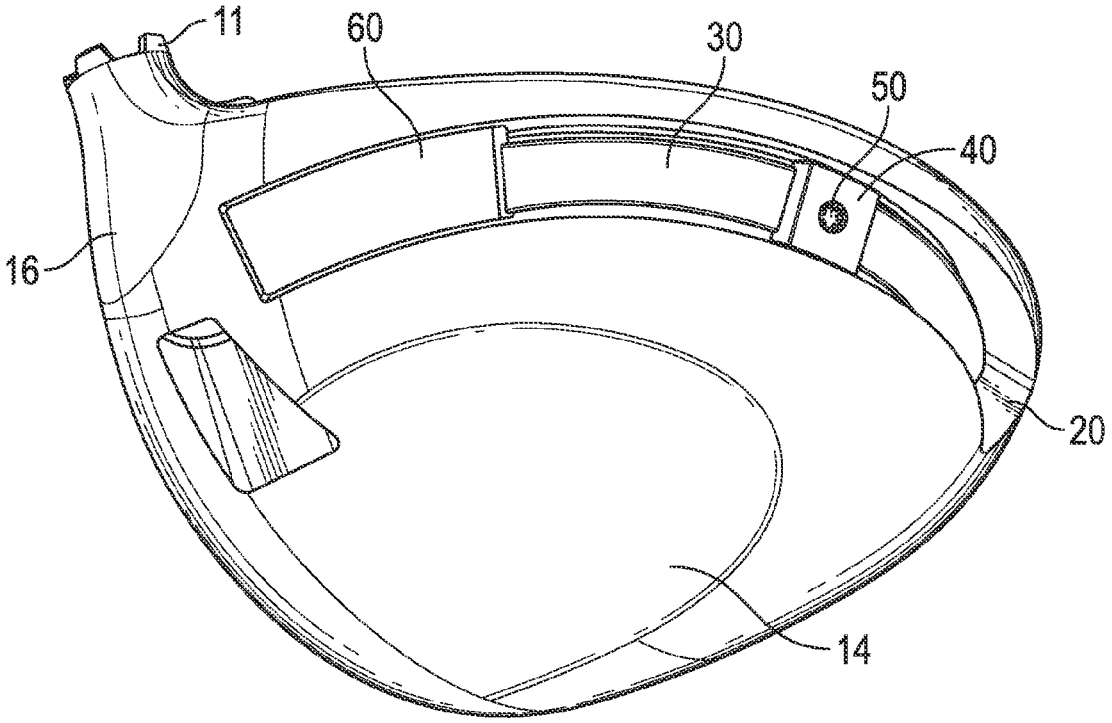
FIG. 7 is another sole perspective view of the embodiment shown in FIG. 1.

Once the track 30 is affixed to the body 19, the weight 40 is slid onto the track 30 via its narrow first end 31, which is then blocked off with the stopper 60 as shown in FIG. 7 to prevent the weight 40 from disengaging from the body 19. The crown 12 may be affixed to the body 19 at any time after the track 30 is affixed to the body 19, and preferably is permanently attached to the body 19 with an adhesive material. The crown 12 is formed from a light-weight material, preferably a non-metal material such as a composite, which may be selected from any of the composite materials disclosed in U.S. Pat. No. 8,460,123 and U.S. patent application Ser. No. 13/912,994, the disclosure of each of which is hereby incorporated by reference in its entirety herein.

The weight 40 disclosed in connection with the preferred embodiment shown herein may have any of the constructions disclosed in U.S. patent application Ser. No. 14/033,218, and may also be added to and removed from the golf club head 10 as disclosed in that application. Similarly, the channel 20 disclosed herein may have any of the configurations disclosed in U.S. patent application Ser. No. 13/656,271, the disclosure of which is hereby incorporated by reference in its entirety herein, and the channel 20 disclosed herein may disposed anywhere on a golf club head 10, including the sole, 14, crown 12, face, 15, and ribbon portions. Though the embodiment disclosed herein is provided in a driver, the adjustable weighting configuration shown herein may also be used with other type of golf clubs, including fairway woods, irons, hybrids, and putters.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:
- a body comprising a face and a sole;
- a crown;
- a track;
- a mechanical fastener; and
- a first weight comprising a lower recess,
- wherein the sole comprises a channel having at least two walls and a floor,
- wherein the track is at least partially disposed within the charnel,
- wherein the weight receives an upper portion of the track within the lower recess, and
- wherein the weight is reversibly affixed to the track with the mechanical fastener.

2. The golf club head of claim 1, wherein the channel comprises a floor and a track opening, wherein the track comprises a lower edge sized to fit within the track opening, and wherein the track is permanently affixed to the body within the channel.

3. The golf club head of claim 1, wherein the body is integrally cast from a metal material, wherein the track is composed of a metal material, and wherein the crown is composed of a composite material.

4. The golf club head of claim 1, wherein the weight comprises an upper recess, a threaded bore that connects the upper recess with the lower recess, and two hooked lower edges, wherein the mechanical fastener comprises a threaded extension sized to fit within the threaded bore, and wherein the track comprises a T-shaped cross section.

5. The golf club head of claim 1, wherein the body comprises a plurality of internal ribs, and wherein each of the plurality of internal ribs is affixed to the floor of the channel.

6. The golf dub head of claim 1, further comprising a stopper sized to fit within the channel and over the track, and wherein the stopper prevents the weight from detaching from the track.

7. The golf club head of claim 1, wherein the track comprises a protective cover.

8. The golf club head of claim 6, wherein the stopper is composed of a material selected from the group consisting of plastic, composite, and rubber.

9. The golf club head of claim 6, wherein the stopper is composed of a material selected from the group consisting of stainless steel, titanium alloy, aluminum alloy, and tungsten alloy.

10. The golf club head of claim 1, wherein the track comprises a first end having a first width and a second end having a second width, and wherein the first width is smaller than the second width.

11. The golf club head of claim 1, further comprising a second weight, wherein the second weight comprises a lower recess sized to receive an upper portion of the track.

12. The golf club head of claim 2, wherein the track is welded to the body.

13. The golf club head of claim 1, further comprising an adjustable hosel assembly.

14. The golf club head of claim 1, wherein the golf club head is selected from the group consisting of a driver-type head, a fairway wood-type head, an iron-type head, a hybrid-type head, and a putter-type head.

15. A wood-type golf club head comprising:
- a metal body comprising a face, a hosel, a heel side, a toe side, and a sole;
- a composite crown;
- a metal track comprising a lower edge, a first end having a first width, a second end having a second width, and an upper portion having an upper surface,
- a screw comprising a head and a threaded extension;
- a weight comprising an upper recess, a lower recess sized to receive the upper portion of the track, and a threaded bore connecting the upper recess with the lower recess; and
- a stopper,
- wherein the sole comprises a channel having at least two walls, a floor, and a track opening,
- wherein the channel extends from the heel side to the toe side,
- wherein the lower edge of the track is disposed within the track opening,
- wherein the weight is reversibly fixed to the track with the screw, and
- wherein the stopper prevents the weight from disengaging from the track.

16. The wood type golf club head of claim 15, wherein the track is welded to the body.

17. The wood-type golf club head of claim 15, wherein the track comprises a protective cover.

18. The wood-type golf club head of claim 15, wherein the body comprises a plurality of ribs, and wherein each of the ribs is affixed to an interior surface of the channel floor.

19. The wood-type golf club head of claim 15, wherein the track is composed of anodized aluminum.

* * * * *